United States Patent [19]

Herrmann

[11] Patent Number: 4,694,623

[45] Date of Patent: Sep. 22, 1987

[54] CLOSED RING-SHAPED REINFORCING MEMBER FOR A CONCRETE STRUCTURE

[75] Inventor: Gero Herrmann, Karlsfeld, Fed. Rep. of Germany

[73] Assignee: Dyckerhoff & Widmann Aktiengesellschaft, Fed. Rep. of Germany

[21] Appl. No.: 808,867

[22] Filed: Dec. 13, 1985

[30] Foreign Application Priority Data

Dec. 19, 1984 [DE] Fed. Rep. of Germany ..... 8437161

[51] Int. Cl.[4] ..... E04C 3/10; E04C 5/12

[52] U.S. Cl. ..... 52/223 L; 52/230

[58] Field of Search ..... 52/223 L, 230

[56] References Cited

U.S. PATENT DOCUMENTS

| | | | |
|---|---|---|---|
| 3,513,609 | 5/1970 | Lang | 52/230 |
| 4,258,518 | 3/1981 | Xercavins | 52/223 L |
| 4,348,844 | 9/1982 | Schupack et al. | 52/230 |
| 4,484,425 | 11/1984 | Muller | 52/230 X |
| 4,557,087 | 12/1985 | Kitta et al. | 52/230 |
| 4,561,226 | 12/1985 | Tourneur | 52/223 L |

FOREIGN PATENT DOCUMENTS 217194 9/1961 Austria .

*Primary Examiner*—J. Karl Bell

*Attorney, Agent, or Firm*—Toren, McGeady & Associates

[57] ABSTRACT

A closed ring-shaped reinforcing member for use in a concrete structure and which is stressed by annular tensile forces, such as a bell-shaped anchoring body for a prestressing member used in a prestressing concrete structure, is provided around the radially outer surface with a coating of a material which is elastically or plastically deformable under compression. The reinforcing member can deform under the action of annular tensile forces which cause it to stretch, but the presence of the deformable coating on its outside surface prevents the transfer of such deforming forces to the concrete structure, since otherwise such forces could result in the formation of cracks in the structure.

12 Claims, 5 Drawing Figures

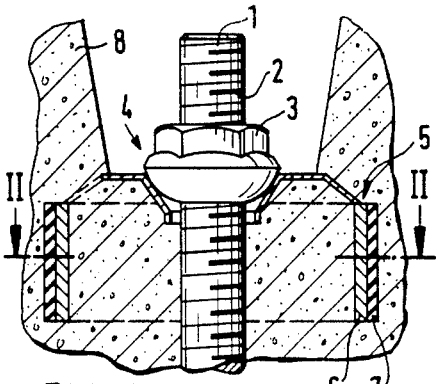
FIG. 1
FIG. 2
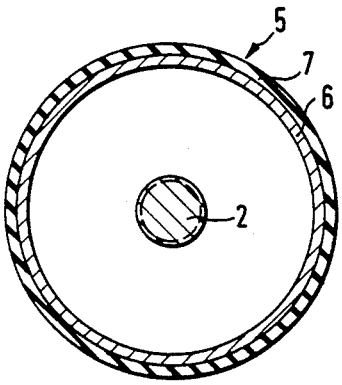
FIG. 3
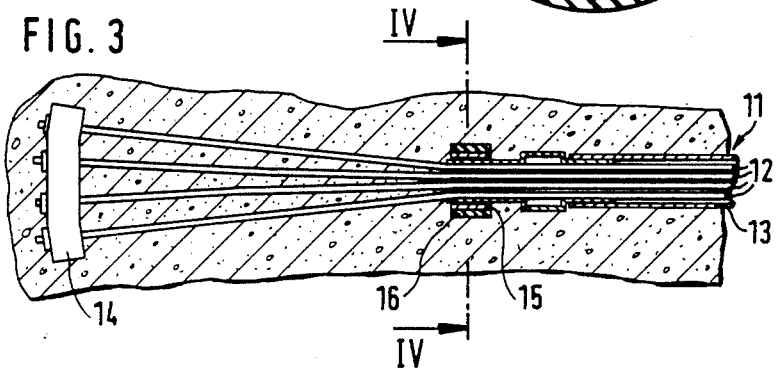
FIG. 4
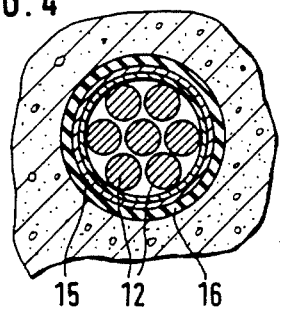
FIG. 5
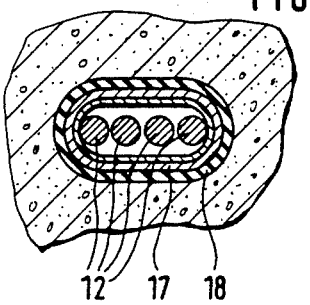

CLOSED RING-SHAPED REINFORCING MEMBER FOR A CONCRETE STRUCTURE

BACKGROUND OF THE INVENTION

The present invention is directed to a closed ring-shaped reinforcing member for use in concrete where the member is stressed by annular tensile forces.

In a bundled prestressing member for prestressed concrete, the individual parts of the member, such as steel wires or strands, in the region between their anchorages are positioned as closely together as possible with only a minimum distance between them. The individual parts are spread out in a fan-shaped manner as they approach the anchorage since in the anchorage a larger space between the parts is required. At the location where the individual parts commence to be spread apart, deflecting forces directed radially outwardly are developed and such forces produce transverse tensile stresses in the concrete structure and such stresses can result in cracks. To absorb these deflecting forces it is known to arrange an additional reinforcement, such as a spiral shaped member, in the region where the deflection of the parts takes place. The installation of such a spiral shaped member involves additional effort, particularly because the spiral shaped member must be maintained at a certain distance from the prestressing member.

Further, it is known to provide a steel deflection ring in place of a spiral shaped member as the reinforcing member so that it absorbs the deflection forces as annular tensile forces. Under the action of the annular tensile forces, the deflection ring stretches, particularly in slender structural members, so that there exists the danger of cracks developing which require additional reinforcement.

Similar problems exist in prestressed member anchorages. In such anchorages it is known to use a bell-shaped anchoring body for individual as well as bundled prestressed members. The anchoring body includes an inclined recess face for an anchoring nut or an anchoring plate and includes an annular or tubular body with a cylindrical cross-section for absorbing transverse tensile stresses, note Austrian Patent No. 217 194.

In bell-shaped anchorages, the stretching of the annular body, because of the high forces acting in the concrete enclosed within it, can become so great that cracks develop in the region of the concrete structure around the anchorage. In particular in slender structures, such as slender girders, the development of cracks may endanger the important anchorage due to corrosion by the passage of harmful air and moisture through the cracks.

SUMMARY OF THE INVENTION

Therefore, the primary object of the present invention is to provide a closed ring-shaped reinforcing member for providing a simple arrangement for reducing or eliminating the danger of cracks in the surrounding concrete when the reinforcing member is stressed by annular tensile forces.

In accordance with the present invention, the reinforcing member is provided on its radially outer surface with a coating of a material which deforms under compression.

The coating can be a closed-pore elastically deformable material, such as foam rubber or the like, or a plastically deformable material, such as polystyrol or the like.

The basic concept of the invention involves embedding the ring-shaped reinforcing member in concrete so that it can deform by stretching under the action of the annular tensile forces without transmitting any corresponding forces to the concrete structure. This characteristic is achieved in the simplest manner by enclosing the radial outer surface of the reinforcing member with a coating of a closed-pore material which is impermeable to water and air and serves to form a space free of concrete which can yield elastically and/or plastically as a consequence of the compression forces generated during the deformation of the reinforcing member.

The present invention can be employed in all ring-shaped reinforcing members stressed by annular tensile forces, and in particular can be used in bell-shaped anchorages as well as deflection rings in the region where a bundled prestressing member is spread outwardly.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing

FIG. 1 is a partial axially extending section of a so-called bell anchorage within a concrete structure for anchoring an individual tendon or prestressing member is prestressed concrete;

FIG. 2 is a cross-sectional view taken along the line II—II in FIG. 1;

FIG. 3 is a partial cross-sectional view through a concrete structure with an anchorage for a spread-out bundled prestressing member;

FIG. 4 is a cross-sectional view of a deflecting ring taken along the line IV—IV in FIG. 3; and FIG. 5 is a cross-sectional view, similar to FIG. 4, through another embodiment of a deflection ring.

DETAILED DESCRIPTION OF THE INVENTION

In FIGS. 1 and 2 a reinforcing member embodying the present invention is illustrated in axially extending and transverse cross-section in an example of a bell-shaped anchorage for a prestressing member used in prestressed concrete. The prestressing member 1 is provided, at least at its end, with a thread 2 on which an anchoring nut 3 is screwed against the upper portion 4 of an anchoring body 5.

The lower portion 6 of the anchoring body is formed by a tubular member of suitable length which is secured to the upper portion 4, such as by welding.

In this anchorage, the anchoring forces developed by the lower spherically shaped portion of the anchoring nut are absorbed by the cylindrically or circularly shaped lower portion 6 of the anchoring body 5 and acts as a reinforcing member for absorbing the lateral tensile forces and is loaded by annular tensile forces. The tubular or ring-shaped lower portion 6 is provided on its radially outer surface with a coating 7 of a closed-pore elastically deformable material, such as foam rubber or the like. The coating 7 extends for the axial length of the lower portion 6 and also extends completely around the lower portion 6. The coating 7, because of its compressibility, forms a free space for the deformation of the ring-shaped reinforcing member 6 so that the member can deform by widening due to the annular tensile forces. Such outward deformation without the presence of the coating 7 could result in forces applied to the surrounding concrete of the structure 8 in which the anchorage is embedded, which could cause the development of cracks in the concrete.

In FIGS. 3 and 4 there is another embodiment of the reinforcing member incorporating the present invention with the reinforcing member being in the form of a deflection ring for absorbing forces developed in the spreading out of the individual parts of a bundled prestressing cable for presressing concrete. The bundled prestressing cable 11 is made up of a number of individual elements 12, such as steel wires or strands, which extend through a sheathing tube 13 and are spread out so that they can be secured in an anchoring plate 14. To absorb the forces which develop at the commencement of the spreading out action and which forces are oriented transversely to the axis of the presetressing cable, a steel deflection ring 15 is arranged around the cable 11. The radially outer surface of the deflection ring is covered with a coating 16 of a closed pore, elastically deformable material, such as foam rubber or the like. In this embodiment, the deformable coating 15 affords the ability of the deflection ring 15 to deform outwardly in a widening action because of radial stresses without transferring such stresses into the enclosing concrete structure.

While in the embodiment displayed in FIGS. 3 and 4 the individual elements 12 are arranged in a radially symmetrical fashion and the deflection ring is circularly shaped in cross-section, it is also possible in accordance with the present invention to provide the deflection ring as an oval-shaped member for use in narrow or thin concrete structures, such as shown in FIG. 5. In FIG. 5, four individual elements are arranged in side-by-side relation in a row and are laterally enclosed by an oval-shaped deflection ring 17 with the radially outer surface of the ring being covered with a coating 18 of an elastically deformable material.

While specific embodiments of the invention have been shown and described in detail to illustrate the application of the inventive principles, it will be understood that the invention may be embodied otherwise without departing from such principles.

I claim:

1. A closed axially extending ring-shaped reinforcing member to be embedded in and included within a concrete structure for laterally encircling at least one prestressing member, said reinforcing member being stressable by annular tension forces and preventing the transfer of such forces from said ring-shaped reinforcing member into the concrete in which said reinforcing member is embedded, said ring-shaped member is formed of steel and has a radially inner surface and a radially outer surface each extending in the general direction of the axis thereof and completely encircling the axis, and a coating of a material deformable under compression located on and completely covering the radially outer surface of said steel ring-shaped member whereby with said coating in surface contact with the concrete embedding the ring-shaped reinforcing member said coating deforms and prevents the transfer of annular tension forces to the concrete.

2. A closed ring-shaped reinforcing member, as set forth in claim 1, wherein the coating is a closed-pore elastically deformable material such as foam rubber.

3. A closed ring-shaped reinforcing member, as set forth in claim 1, wherein said coating is a closed-pore plastically deformable material such as polystyrol.

4. A closed ring-shaped reinforcing member, as set forth in claim 1, wherein said coating is fixed to the radially outer surface of said reinforcing member, such as by foaming, and bonding.

5. A concrete structure including a concrete member, at least one axially elongated prestressing member extending through and located within said concrete member, a closed ring-shaped reinforcing member located in said concrete member and laterally encircling said at least one prestressing member and enclosed within said concrete member, said reinforcing member is formed of steel and has an axis generally parallel with the axis of said prestressing member, said reinforcing member has a radially inner surface and a radial outer surface each extending in the general direction of the axis and completely encircling the axis, and a coating of material deformable under compression located on and completely covering the radially outer surface of said reinforcing member with said coating disposed in surface contact with the concrete member so that annular tension forces stressing the reinforcing member are prevented from transferring into said concrete member.

6. A concrete structure, as set forth in claim 5, wherein the coating is a closed-pore elastically deformable material.

7. A concrete structure, as set forth in claim 6, wherein said deformable material is foam rubber.

8. A concrete structure, as set forth in claim 5, wherein said coating is a closed-pore plastically deformable material.

9. A concrete structure, as set forth in claim 8, wherein said plastically deformable material is polystyrol.

10. A concrete structure, as set forth in claim 5, wherein said coating is fixed to the radially outer surface of said reinforcing member by one of foaming and bonding.

11. A concrete structure, as set forth in claim 5, wherein an anchor member is secured to said prestressing member, said reinforcing member includes a part extending transversely of the axis of said reinforcing member inwardly from the inner surface thereof and supporting said anchoring member, and said deformable coating being located outwardly from said part.

12. A concrete structure, as set forth in claim 5, including an anchoring plate located within said concrete member and spaced in the axial direction of said prestressing member from said reinforcing member, said prestressing member comprising a bundled prestressing cable comprising a number of individual elements, said elements disposed in generally parallel relationship within said reinforcing member and being spread laterally from one another between said reinforcing member and said anchoring plate with said individual elements being anchored in said anchoring plate.

* * * * *